US012796748B2

(12) United States Patent
Bryan

(10) Patent No.: US 12,796,748 B2
(45) **Date of Patent: *Nov. 17, 2026**

(54) INFANT SAFETY BEDDING

(71) Applicant: Trinetta Janine Bryan, Old Forge, PA (US)

(72) Inventor: Trinetta Janine Bryan, Old Forge, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/194,316

(22) Filed: Apr. 30, 2025

(65) Prior Publication Data

US 2025/0255358 A1 Aug. 14, 2025

Related U.S. Application Data

(63) Continuation-in-part of application No. 18/244,289, filed on Sep. 10, 2023, now Pat. No. 12,543,873.

(60) Provisional application No. 63/509,313, filed on Jun. 21, 2023.

(51) Int. Cl.

| | |
|---|---|
| ***A41B 13/06*** | (2006.01) |
| ***A47D 15/00*** | (2006.01) |
| ***A47G 9/02*** | (2006.01) |

(52) U.S. Cl.

CPC ..... *A41B 13/065* (2013.01); *A47D 15/008* (2013.01); *A47G 9/0246* (2013.01); *A47G 9/0261* (2013.01)

(58) Field of Classification Search

CPC ... A47G 9/0246; A47G 9/0261; A47D 15/008
See application file for complete search history.

(56) References Cited

U.S. PATENT DOCUMENTS

| | | | | |
|---|---|---|---|---|
| 1,885,558 A * | 11/1932 | Smith | ..... | A47D 15/008 2/69.5 |
| 2,677,834 A | 5/1954 | Moynihan | | |
| 3,845,513 A | 11/1974 | Hubner | | |
| 4,202,052 A | 5/1980 | Bilanzich | | |
| 5,208,927 A | 5/1993 | Lachmar | | |

(Continued)

FOREIGN PATENT DOCUMENTS

JP 2016116708 A * 6/2016

OTHER PUBLICATIONS

"ErgoPouch HowTo use Baby Tuck Sheet", May 24, 2022, https://www.youtube.com/watch?v=V7HsLb3AEBE (Year: 2022).*

*Primary Examiner* — Eric J Kurilla
(74) *Attorney, Agent, or Firm* — Peter A Borsari

(57) ABSTRACT

An infant safety bedding comprising a fitted sheet, a blanket affixed to the fitted sheet and having a left flap with a fastening element and a right pocket with fastening element, and an infant harness affixed to the fitted sheet and having three flexible strap members, each having an attachment element. In use, an infant is first secured within the infant harness and then securely wrapped in the right pocket of the blanket by wrapping and attaching the fastening element of the left flap to the fastening element of the right pocket. The infant harness is wrapped around an infant to ensure that the infant is held in place on their back, thereby enhancing the infant's safety by preventing movement including rolling over and slipping down into the attached blanket. In one embodiment, a self-adhering fabric is used as the fastening elements and the attachment elements.

14 Claims, 6 Drawing Sheets

(56) References Cited

U.S. PATENT DOCUMENTS

| | | | | |
|---|---|---|---|---|
| 5,794,285 | A * | 8/1998 | Burch | A47G 9/02 5/500 |
| 6,301,729 | B1 | 10/2001 | Hall | |
| 6,341,396 | B1 * | 1/2002 | Carapezza | A47G 9/023 5/482 |
| 7,370,377 | B2 | 5/2008 | Landry | |
| 8,020,226 | B2 | 9/2011 | Landry | |
| 9,060,620 | B1 * | 6/2015 | Patel | A61F 5/37 |
| 10,758,067 | B2 | 9/2020 | Gaudyn | |
| 11,659,870 | B2 | 5/2023 | Damir et al. | |
| 12,543,873 | B2 * | 2/2026 | Bryan | A47G 9/0246 |
| 2010/0275932 | A1 * | 11/2010 | Shackleton | A47D 5/00 128/872 |
| 2017/0325601 | A1 | 11/2017 | von Yurt et al. | |
| 2022/0110462 | A1 * | 4/2022 | Sack | A47G 9/0223 |

* cited by examiner

INFANT SAFETY BEDDING

CROSS-REFERENCE TO RELATED APPLICATIONS

This application is a continuation-in-part of U.S. patent application Ser. No. 18/244,289, filed Sep. 10, 2023, which claims priority U.S. Provisional Patent Application 63/509,313, filed Jun. 21, 2023.

FIELD OF INVENTION

The present invention relates to an infant safety bedding comprising a fitted sheet having a blanket attached thereto and an infant harness also attached to the fitted sheet. More particularly, the present invention relates to an infant safety bedding comprising a fitted sheet having a blanket and infant harness both attached to the fitted sheet and which is designed to safely secure an infant in a back sleeping position.

BACKGROUND OF THE INVENTION

At birth, an infant's sleeping environment typically is a bassinet or a crib. Based on the American Academy of Pediatrics (AAP) guidelines, it is recommended that an infant sleep on his or her back on a flat, firm sleeping surface, such as a mattress in a bassinet or crib, for the first year of the infant's life. Further, AAP advises to maintain the sleeping environment free of blankets or any loose objects to prevent accidental harm to the infant. As a result, parents and guardians are expected to determine how to keep their infant safe and warm in the sleeping environment.

One conventional option is a wearable blanket, which requires wrapping the infant in a blanket (commonly referred to as swaddling). A drawback to swaddling, especially with older infants, is that the infant's limbs are restricted by inhibiting movement. Moreover, the wrapped blanket can unravel and become loose, thereby creating a potential hazard, sudden death syndrome (SDS), or related issues. As a result, it has been advised to discontinue swaddling an infant after the infant has reached the age of two months, or when the infant has developed the mobility to roll over. Due to these afore-mentioned risks, the option of swaddling is not recommended by AAP.

Another conventional option for keeping an infant safe in a sleeping environment is a device known as a "sleep sack," which is a weighted bodysuit composed of a blanket-like material within which the infant is placed. A drawback to the "sleep sack" is that the infant is bound within a material that may be stuffy and uncomfortable. It is an option also not recommended by AAP.

PRIOR ART

The prior art is replete with devices and bedding materials designed to keep an infant safe and secure within a sleeping environment. For example, disclosed in U.S. Pat. No. 2,677,834 to Moynihan, shows a crib blanket having multiple flexible strap members which are used to strap an infant within the blanket and are secured to the rail of the crib. In U.S. Pat. No. 5,208,927 to Lachmar, a bottom fitted sheet having a zipper portion that mates with the zipper portion of a blanket of a blanket/top sheet combination. The Lachmar bedding apparatus is directed to ready-to-use and does not teach securing an infant within the apparatus.

U.S. Pat. No. 6,301,729 B1 to Hall provides a child safety sack for securing an infant in a back sleeping position on a crib mattress, having a top panel fastened to a bottom panel to form a pocket that slides onto one end of a crib mattress to ensure a snug fit. The top panel has an opening flap extending lengthwise from an open top edge to a closed bottom edge, the two overlapping edges being secured by an adjustable fastener to secure an infant therein. A significant drawback to the Hall safety sack is that it slides over the bottom or top end of a crib mattress. Similarly, Japanese Patent Application 2016-116708A provides a mattress cover bedding body that includes a mattress being disposed within an opening of a rear body member and which includes a left body and a right body which can be overlapped to create a neck opening.

Related U.S. Pat. Nos. 7,370,377 B2 and 8,020,226 B2 to Landry disclose a fitted crib safety sheet and a separable blanket within which an infant can be wrapped and secured with four mating strips. The blanket can be attached to the fitted sheet, preferably sewn to the middle front surface of the sheet or can be detachable.

Infant sleeping or swaddling garments which are integrated with a bedding component are known in the prior art as exemplified in U.S. Pat. No. 3,845,513 to Hubner, U.S. Pat. No. 4,202,052 to Bilanzich, U.S. Pat. No. 11,659,870 B2 to Damir et al., and U.S. Patent Application Publication 2017/0325601 A1 to von Yurt et al.

U.S. Pat. No. 10,758,067 to Gaudyn discloses an infant sleep aid comprising a partially fitted sheet tucked into and secured onto a side of a mattress and on a second end of the mattress, the sleep aid is a blanket which is attached to the fitted sheet and being of sufficient size to fold over an infant, the fitted sheet having hook and loop fasteners and the blanket having matable hook and loop fasteners situated on the blanket opposite the fitted sheet, such that when the blanket is folded over, the hook and loop fasteners are mated to form a pocket capable of containing an infant. One drawback with Gaudyn is that with force from the infant, the blanket could detach and become loose, creating a hazard within the infant's sleep environment. Further, the infant is not secured sufficiently to prevent the infant from rolling over from the preferred back sleeping position.

Despite the many devices developed in the prior art for creating a safe and secure sleeping environment for an infant which maintains the infant in a back sleeping position, a need still exists for an infant bedding system which includes an infant harness for retaining an infant in a back sleeping position, a fitted sheet for a crib mattress to which a blanket is affixed, the blanket having a left flap and a right pocket which can be removably connected such that the blanket can be securely wrapped around the infant.

SUMMARY OF THE INVENTION

The invention of the present subject matter relates to an infant safety bedding comprising a fitted sheet, a blanket having left, right and bottom edges is attached to the lower portion perimeter of the fitted sheet, and having a left flap and a right pocket, and an infant harness also affixed to the fitted sheet. In use, the infant first is placed into and safely secured within the infant harness and then the left flap and right pocket of the blanket are brought together and removably attached to each other by fastening means well known in the art.

Accordingly, it is an object of the present subject matter to provide an infant safety bedding which includes a fitted sheet having an infant harness comprising flexible strap members which are affixed to the fitted sheet, each flexible strap member having fastening means disposed thereon.

It is another object of the present subject matter to provide an infant safety bedding having an infant harness with flexible strap members which utilize self-stick fabric or hook and loop fasteners to secure the strap members about an infant.

It is still another object of the present subject matter to provide an infant safety bedding which will safely secure an infant in a back sleeping position.

It is a yet another object of the present subject matter to provide an infant safety bedding having a fitted sheet and blanket, the blanket having left, right and bottom edges attached to the perimeter of the fitted sheet, a left flap, and a right pocket, the left flap being detachably securable to a right pocket.

It is a further object of the present subject matter to provide an infant safety bedding having a fitted sheet and blanket attached thereto, the blanket having a left flap, and a right pocket, the left flap being detachably securable to a right pocket by self-stick fabric or hook and loop fasteners.

These and other objects of the present subject matter are accomplished by providing an infant safety bedding comprising a fitted sheet, a blanket attached to the fitted sheet and having a left flap and a right pocket, the left flap being detachably secured to the right pocket, and an infant harness affixed to the fitted sheet, the infant harness comprising flexible strap members which safely and easily will secure an infant in a back sleeping position.

DETAILED DESCRIPTION OF THE INVENTION

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements and are not drawn to scale. In the following description, numerous specific details are set forth to clearly describe various specific embodiments disclosed herein. One skilled in the art, however, will understand that the presently claimed invention may be practiced without all the specific details discussed below. In other instances, well known features have not been described so as not to obscure the invention.

It is to be understood that the phraseology and terminology used herein is for the purpose of description and should not be regarded as limiting. The use of the terms "including", "comprising", "having", and variations thereof herein is meant to encompass the items listed thereafter and equivalents thereof as well as additional items.

The present subject matter is directed an infant safety bedding which is designed to safely secure an infant in a back sleeping position on a crib or basinet mattress. The infant safety bedding comprises a fitted sheet, a blanket attached to the fitted sheet, and a harness attached to the fitted sheet. The fitted sheet can be dimensioned in varying sizes to accommodate crib and basinet mattresses.

Figure 1:
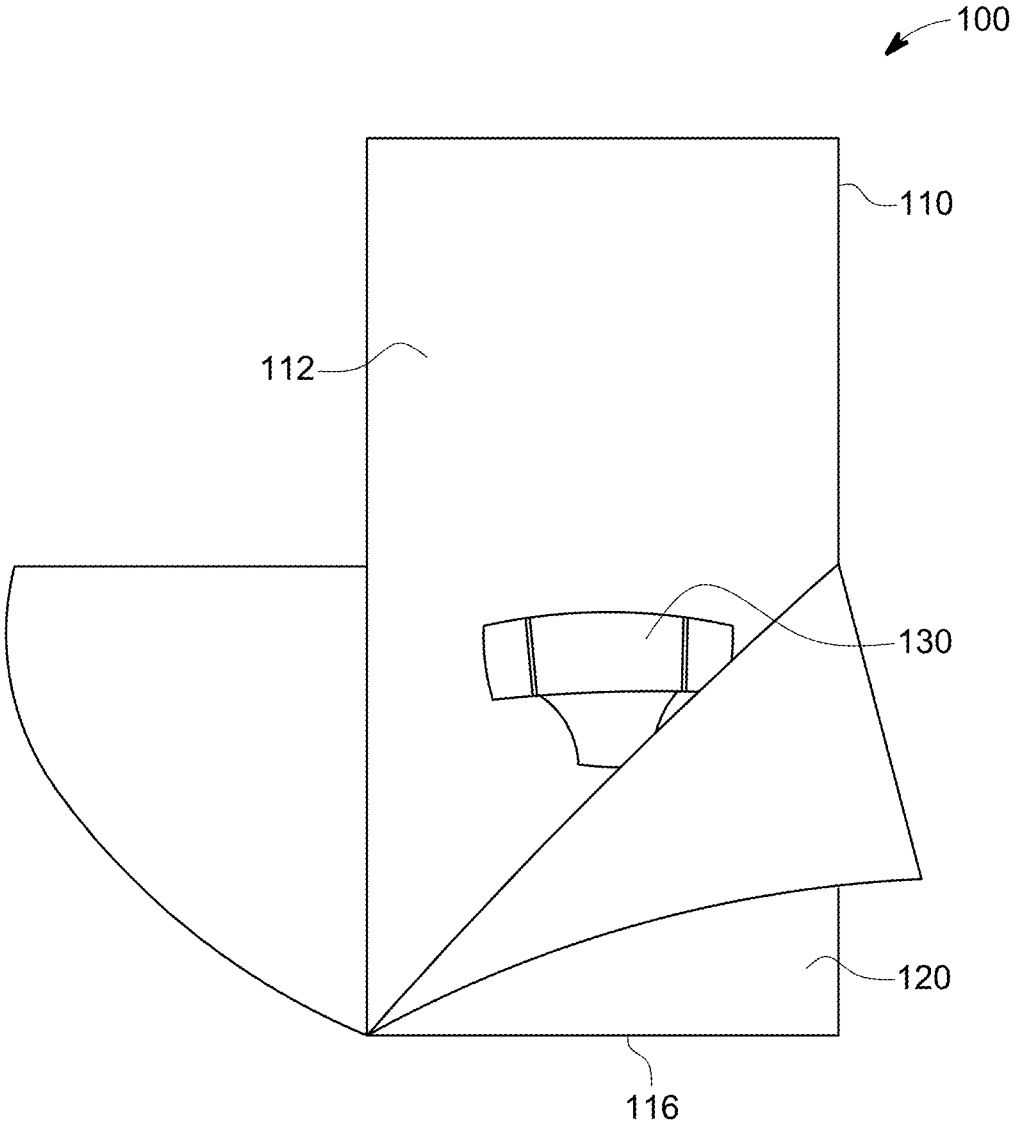
FIG. 1 is a top view of the infant safety bedding of the present subject matter illustrating an infant harness on a fitted sheet and a blanket with an open right pocket and open left flap.

Referring to FIG. 1, an infant safety bedding 100 is shown comprising a fitted sheet 110 having an upper surface 112, lower side edges 114, bottom edge 116, and a standard elastic band (not shown) at its perimeter such that the sheet can be fitted onto a mattress as is known to anyone skilled in the art. The infant safety bedding further comprises a blanket 120 which is affixed to the fitted sheet 110 and an infant harness 130, also affixed to the fitted sheet. The fitted sheet can be in the form of a thin fabric material, suitable examples of which include natural fibers like cotton, linen, silk, and bamboo, as well as synthetic options like polyester, microfibers, and flannel.

Figure 2:
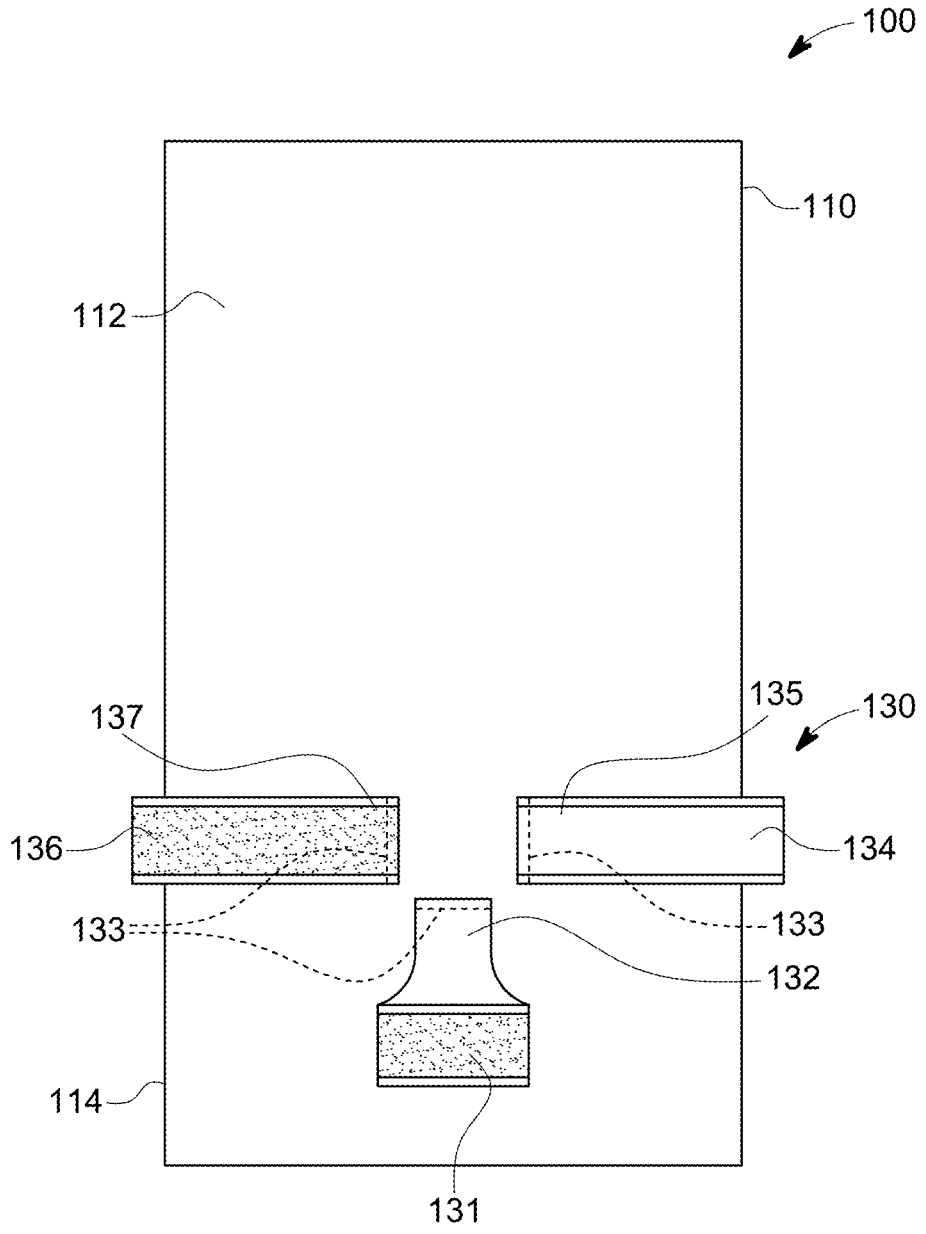
FIG. 2 is a top view of the infant safety bedding of the present subject matter illustrating an infant harness having three flexible strap members.
Figure 3:
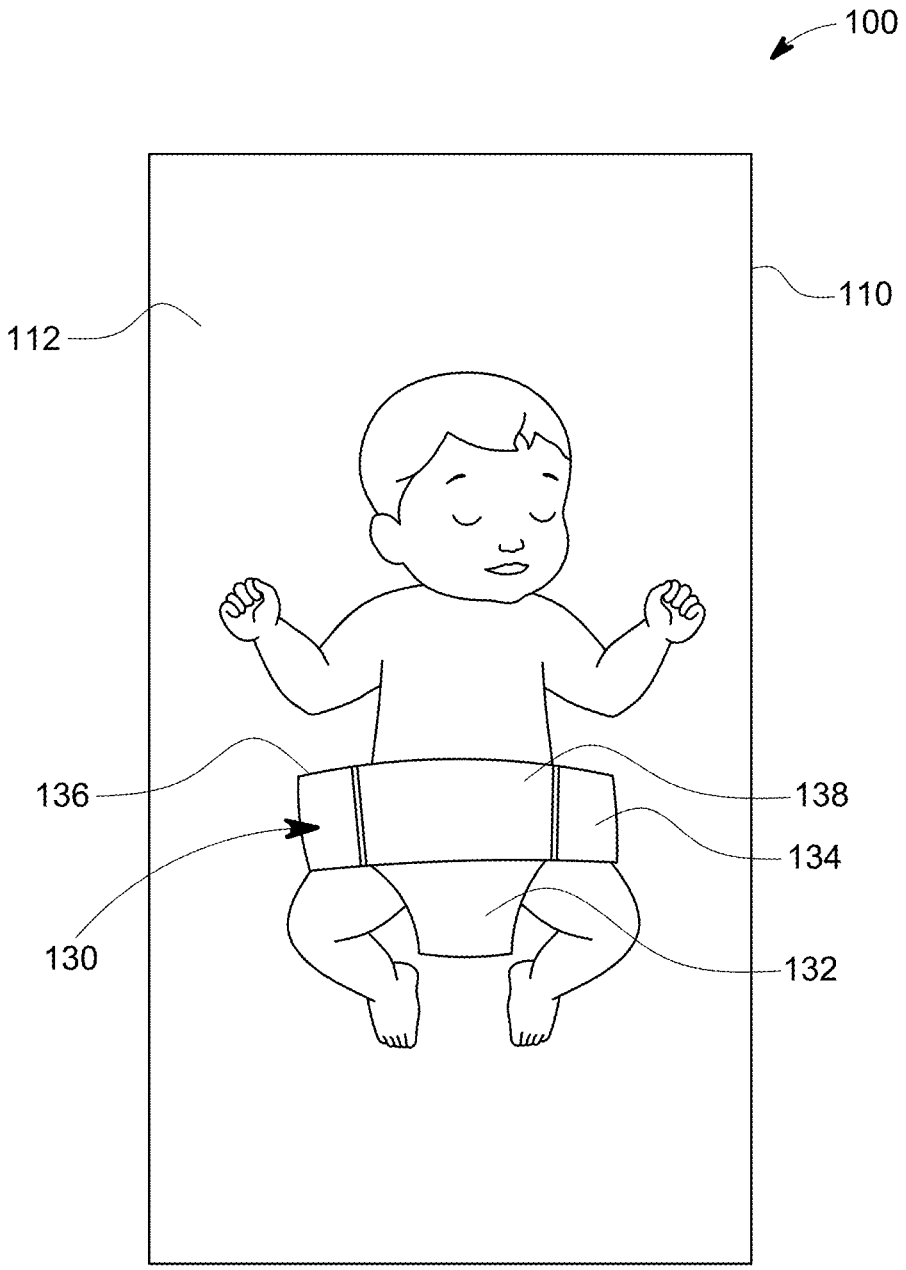
FIG. 3 is a top view of the infant safety bedding of the present subject matter illustrating an infant harness having three flexible strap members removably attached to each other to secure an infant in a back sleeping position.

As shown in FIG. 2 and FIG. 3, the infant harness 130 comprises three flexible harness strap members, each flexible strap being affixed to the fitted sheet by stitching. More particularly, the infant harness comprises a bottom harness strap member 131 having a proximal end 132 affixed to the fitted sheet by stitching 133, a right harness strap member 134 having a proximal end 135 affixed to the fitted sheet by stitching 133 and a left harness strap member 136 having a proximal end 137 affixed to the fitted sheet by stitching 133. Each of the flexible strap members is provided with an attachment element distal to each flexible strap member's proximal end. Preferably, the attachment element is a self-adhering fabric material such that the flexible strap members can be removably attached to each other easily and quickly. A preferred self-adhering fabric material for use with the flexible harness straps is GoodCatch™, a self-adhering fastening fabric that is soft, silent, and strong, taking on strength up to 10 KG. Composed of a high-density polyester microfiber, this self-adhering fabric produces no sound, feels like fleece, and adheres to itself immediately by frictional force, resulting in a secure bond without pulling apart. It is to be understood that other attachment elements can be used for removably fastening each of the flexible harness strap members, including, for example, hook and loop fasteners, snap buttons, and button/button hole arrangement. Each harness strap is composed of a stretchable fabric. Preferably, each harness strap is composed of a blend of cotton and elastane which provides a gentle stretch and allows the straps to adapt to different infant sizes for a secure and comfortable fit.

In an alternate embodiment, the proximal ends of the right harness strap member and the left harness strap member are affixed, such as by stitching, to the underside of the fitted sheet to ensure that the fitted sheet remains in place when the left harness strap member and right harness strap member are pulled and brought together to secure an infant in the back sleeping position.

In use, an infant is placed on its back on the fitted sheet 110, the left harness strap member 136 and the right harness strap member 134 are brought together and removably attached at connection point 138 over body of the infant and the bottom harness strap member, positioned between the infant's legs, is wrapped upwardly and removably attached to connection point 138. Although in the preferred embodiment shown in FIG. 2, each flexible strap member is stitched to the fitted sheet, it should be understood that the flexible strap members may be affixed to the fitted sheet 110 by any suitable means as will be obvious to those skilled in the art.

Figure 4:
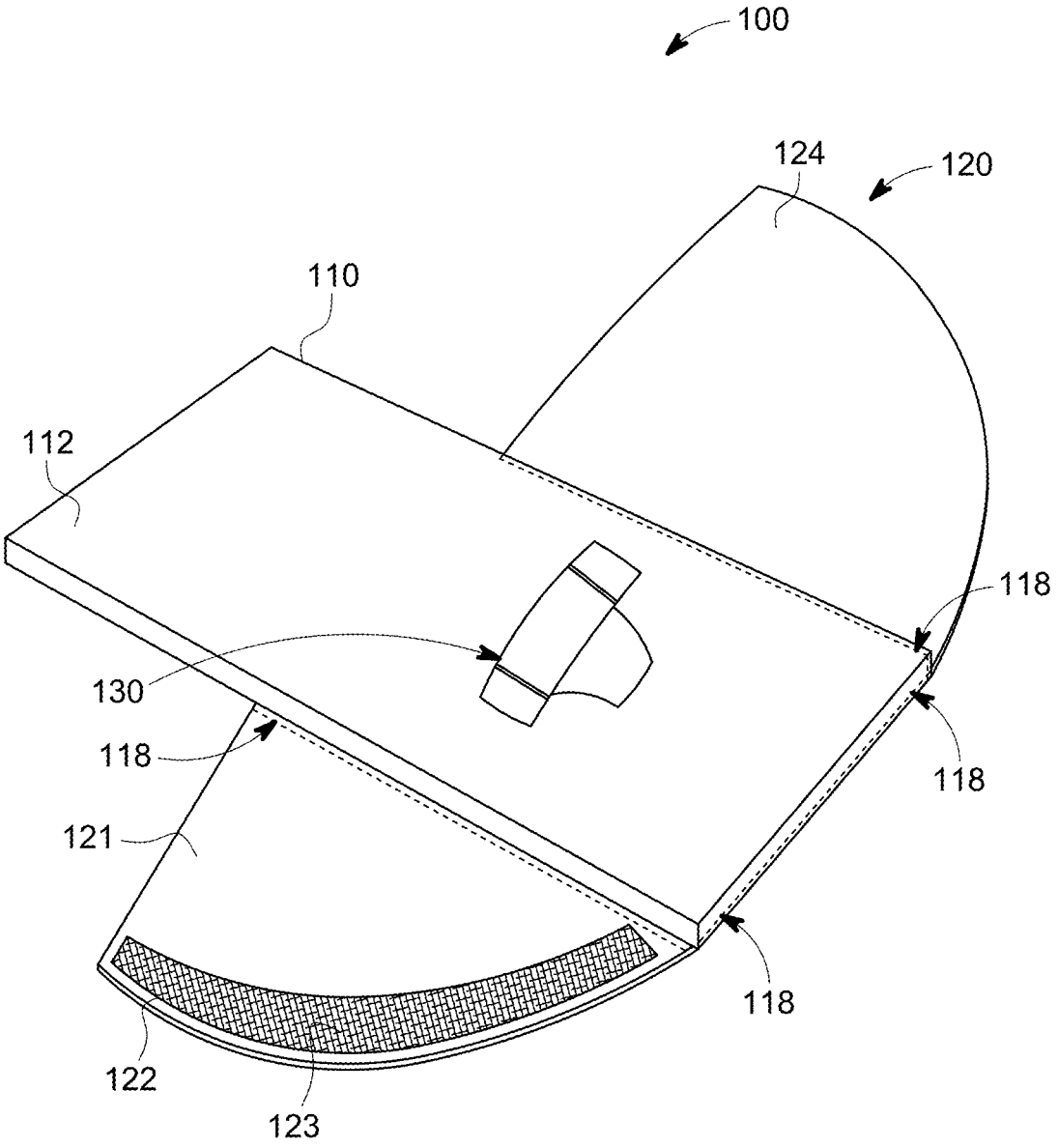
FIG. 4 is a top perspective view of the infant safety bedding prior to assembly illustrating that the blanket is sewn to the perimeter of the fitted sheet.

FIG. 4 illustrates that the blanket 120 of the infant safety bedding 100 is affixed to the perimeter of the fitted sheet 110 such as by stitching 118, the stitching being near the conventional elastic band of the fitted sheet. It is to be understood that FIG. 4 simply illustrates the stitching of the blanket to the fitted sheet and not the final product as depicted in FIG. 5.

Figure 5:
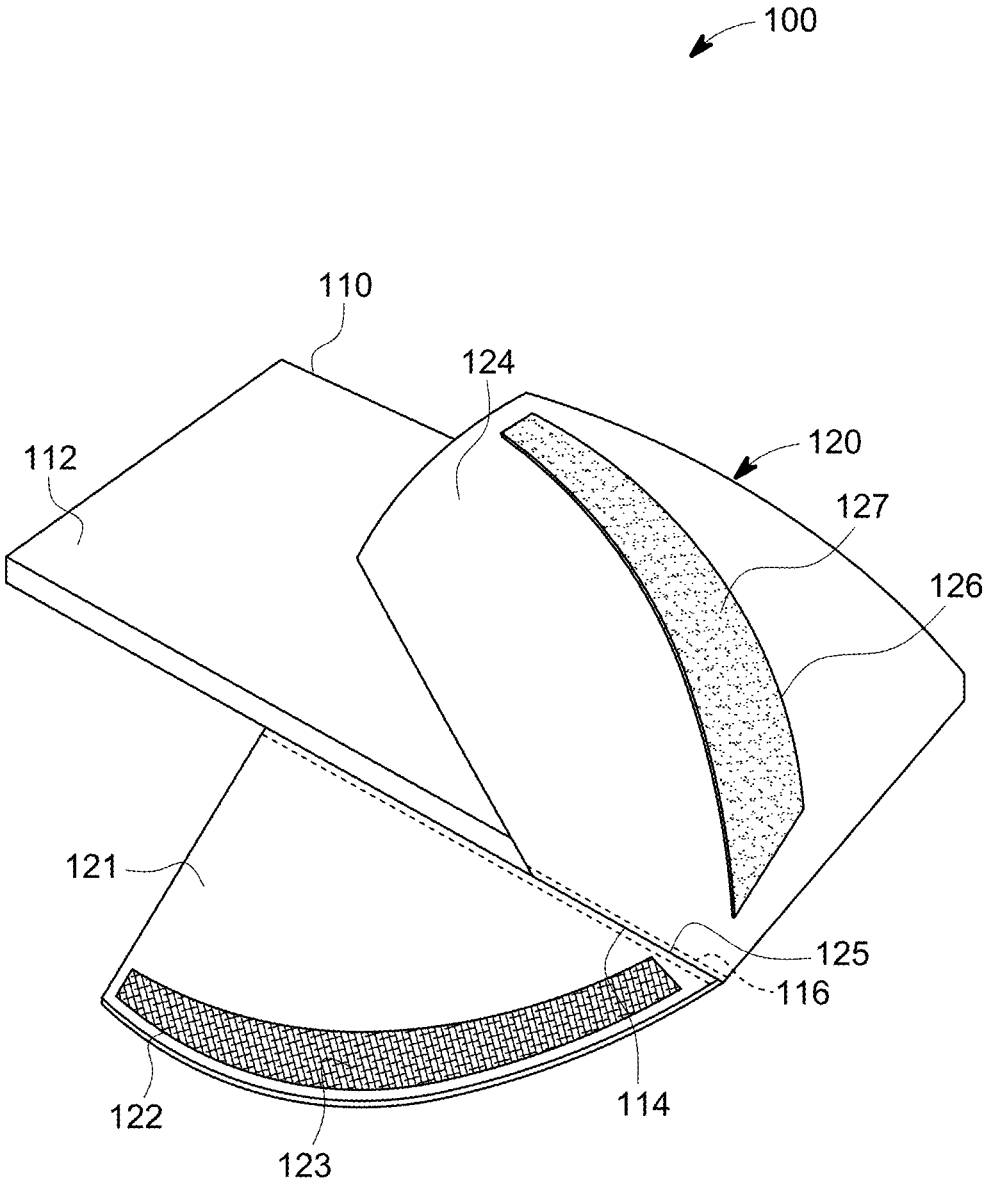
FIG. 5 is a top perspective view of the infant safety bedding of the present subject matter.

As best illustrated in FIG. 5, the blanket 120 comprises a left flap 121 having an inner edge 122 with a first fastening element 123 affixed thereto and a right pocket 124 having a lower edge 125, and an upper surface portion 126 with a second fastening element 127 affixed thereto. The lower blanket edge 125 of the blanket 120 is affixed to the lower sheet edge 114 of the fitted sheet 110. Having the lower blanket edge 125 affixed to the lower sheet edge ensures that when the left flap 121 is wrapped over the right pocket 124, no gaps are present. Preferably, the lower blanket edge 125 is affixed to the lower sheet edge 114 by stitching 116. The first fastening element 123 may be in the form of a hook fastener affixed to the inner edge 122 of the left flap such as by stitching and the second fastening element 127 may be in the form of a loop fastener stitched to upper surface portion 126 of the right pocket flap. In another embodiment, the first fastening element and the second fastening element may be composed of a self-adhering fabric material. The upper surface portion 126 with the second fastening element affixed thereto has a greater surface area and is wider than the first fastening element 123. This configuration allows the user to adjust the desired tightness of the blanket when the fastening elements are joined based on the size of the infant.

The blanket material may be composed of any natural fiber or synthetic fiber material, and preferably contains an elastane material. In the preferred embodiment, the blanket is composed of a blend of cotton and elastane, this specific blend provides a gentle stretch that adds a light resistance to help keep the infant securely in place. This blend of cotton and elastane also allows for natural leg movement, ensuring comfort of the infant. Elastane is a synthetic fiber having superior elasticity properties.

Figure 6:
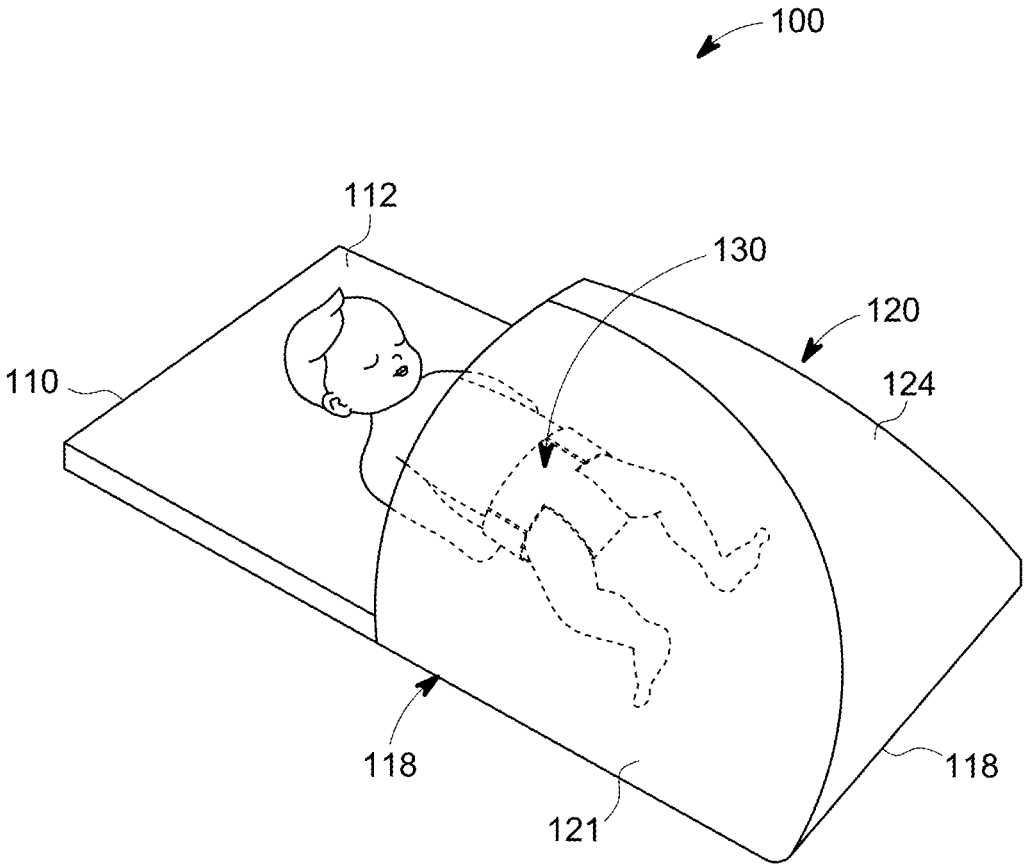
FIG. 6 is a top perspective view of the infant safety bedding of the present subject matter having an infant secured therein.

FIG. 6 illustrates a top perspective view of an infant securely retained with the infant safety bedding of the present subject matter. More particularly, the infant safely is secured in the infant harness as depicted in FIG. 3 and is wrapped in the blanket 120 as the left flap 121 has been removably attached to the right pocket 124.

While several illustrative embodiments of the invention have been shown and described, numerous variations and alternative embodiments will occur to those skilled in the art. Such variations and alternative embodiments are contemplated and can be made without departing from the scope of the invention as defined in the appended claims.

The foregoing detailed description of exemplary and preferred embodiments is presented for purposes of illustration and disclosure in accordance with the requirements of the law. It is not intended to be exhaustive nor to limit the invention to the precise form(s) described, but only to enable others skilled in the art to understand how the invention may be suited for a particular use or implementation. The possibility of modifications and variations will be apparent to practitioners skilled in the art. No limitation is intended by the description of exemplary embodiments which may have included tolerances, feature dimensions, specific operating conditions, engineering specifications, or the like, and which may vary between implementations or with changes to the state of the art, and no limitation should be implied therefrom. Applicant has made this disclosure with respect to the current state of the art, but also contemplates advancements and that adaptations in the future may take into consideration of those advancements, namely in accordance with the then current state of the art. It is intended that the scope of the invention be defined by the Claims as written and equivalents as applicable. Reference to a claim element in the singular is not intended to mean "one and only one" unless explicitly so stated. Moreover, no element, component, nor method or process step in this disclosure is intended to be dedicated to the public regardless of whether the element, under the provisions of 35 U.S.C § 112, sixth paragraph, unless the element is expressly recited using the phrase "means for . . . " and no method or process step herein is to be construed under those provisions unless the step, or steps, are expressly recited using the phrase "step(s) for. . . . "

The invention claimed is:

1. An infant safety bedding comprising:

a. a fitted bed sheet with attached blanket comprising:

i. a fitted bed sheet having elastic band which is adapted to overlie the top surface and sides of a mattress;

ii. an attached blanket secured to said fitted bed sheet, said attached blanket having a left flap and a right pocket;

the right pocket having a top left side, a bottom left side, a top right side, and a bottom right side, wherein the bottom left side of the right pocket is attached to the fitted bed sheet and the top left side of the right pocket is not attached to the fitted sheet;

the left flap having a top left side, a bottom left side, a top right side, and a bottom right side, wherein the top left side and bottom left side of the left flap is attached to the fitted bed sheet and the top right side and bottom right side of the left flap are not attached to the fitted bed sheet, and iii. a hook and loop fastening element adapted to removably join said left flap to said right pocket; and b. an infant harness affixed to said fitted bed sheet, said infant harness comprising three flexible harness strap members, each of the three flexible strap members being provided with an attachment element.

2. The infant safety bedding in accordance with claim 1, wherein said three flexible harness straps comprise a left harness strap having a proximal end affixed to said fitted sheet, a right harness strap having a proximal end affixed to said fitted sheet and a bottom strap member having a proximal end affixed to said fitted sheet, said attachment element of each of said three flexible harness strap members being distal to the proximal end of each of said three flexible harness strap members.

3. The infant safety bedding in accordance with claim 2, wherein said attachment element is a self-adhering fabric material.

4. The infant safety bedding in accordance with claim 3, wherein said self-adhering fabric material is composed of a high-density polyester microfiber.

5. The infant safety bedding in accordance with claim 1, wherein each of said three flexible harness strap members is composed of a stretchable fabric.

6. The infant safety bedding in accordance with claim 5, wherein each of said three flexible harness strap members is composed of a blend of cotton and elastane.

7. The infant safety bedding in accordance with claim 2, wherein said infant harness is used to secure an infant to said fitted bed sheet.

8. The infant safety bedding in accordance with claim 7, wherein said attachment element provided on each of said three flexible harness strap members is a self-adhering fabric material composed of a high-density polyester microfiber.

9. The infant safety bedding in accordance with claim 7, wherein said infant harness is wrapped around an infant to ensure the infant is held in place on their back, thereby enhancing the infant's safety by preventing movement including rolling over and slipping down into the attached blanket.

10. The infant safety bedding in accordance with claim 1, wherein said blanket is composed of a stretchable fabric.

11. The infant safety bedding in accordance with claim 10, wherein said blanket is composed of a blend of cotton and elastane.

12. The infant safety bedding in accordance with claim 1, wherein said first fastening element on said left flap of said blanket is a self-adhering fabric material and wherein said second fastening element on said right pocket of said blanket is a self-adhering fabric material.

13. The infant safety bedding in accordance with claim 12, wherein said self-adhering fabric material is composed of a high-density polyester fabric.

14. The infant safety bedding in accordance with claim 1, wherein said infant harness is wrapped around an infant to ensure the infant is held in place on their back, thereby enhancing the infant's safety by preventing movement including rolling over and slipping down into the attached blanket.

* * * * *